US010551049B2

(12) United States Patent
Shi

(10) Patent No.: US 10,551,049 B2
(45) Date of Patent: Feb. 4, 2020

(54) LIGHTING FIXTURE

(71) Applicant: NOBLE CORPORATION, Zhong Shan (CN)

(72) Inventor: Zhu Shi, Zhong Shan (CN)

(73) Assignee: Gardenia Industrial Limited, Road Town, Tortola (VG)

( * ) Notice: Subject to any disclaimer, the term of this patent is extended or adjusted under 35 U.S.C. 154(b) by 0 days.

(21) Appl. No.: 15/380,841

(22) Filed: Dec. 15, 2016

(65) Prior Publication Data

US 2018/0038583 A1 Feb. 8, 2018

(30) Foreign Application Priority Data

Aug. 4, 2016 (CN) ..... 2016 2 0847781

(51) Int. Cl.

| | |
|---|---|
| ***F21V 29/00*** | (2015.01) |
| ***F21V 17/12*** | (2006.01) |
| ***F21V 19/00*** | (2006.01) |
| ***F21V 23/02*** | (2006.01) |
| ***F21V 23/06*** | (2006.01) |

(Continued)

(52) U.S. Cl.

CPC ..... *F21V 29/77* (2015.01); *F21V 1/02* (2013.01); *F21V 3/00* (2013.01); *F21V 17/12* (2013.01); *F21V 19/0045* (2013.01); *F21V 19/0055* (2013.01); *F21V 19/02* (2013.01);

(Continued)

(58) Field of Classification Search

CPC . F21V 29/77; F21V 29/74; F21V 1/02; F21V 3/00; F21V 17/12; F21V 19/001; F21V 19/0025; F21V 19/003; F21V 19/0035; F21V 19/0045; F21V 17/104; F21V 19/0055; F21V 19/02; F21V 23/003; F21V 23/005; F21V 23/06

See application file for complete search history.

(56) References Cited

U.S. PATENT DOCUMENTS

| | | | | |
|---|---|---|---|---|
| 9,927,104 | B2 * | 3/2018 | Kwong | F21V 29/773 |
| 2006/0146548 | A1 * | 7/2006 | Pazula | F21S 8/065 362/405 |

(Continued)

OTHER PUBLICATIONS

Application 201620847781.2, filed Aug. 4, 2016, CN 205909101 U, p. 1.*

(Continued)

*Primary Examiner* — Alan B Cariaso

(74) *Attorney, Agent, or Firm* — Lewis Roca Rothgerber Christie LLP

(57) ABSTRACT

A lighting fixture includes a lamp support, a lamp arm on the lamp support, a lamp cup shell defining an installation seat at an end of the lamp arm, a lamp shade configured to be supported on the lamp cup shell, and an LED bulb configured to extend into the installation seat. The LED bulb includes a heat sink, an LED lamp panel on the heat sink including LEDs on a base board, a light transmitting cover covering the LED lamp panel, a bottom case assembly on the heat sink including an LED power drive module electrically coupled to the LED lamp panel, and electrical connection members for electrically coupling the LED bulb to the lamp cup shell. A screw press ring is configured to attach the LED bulb to the lamp shade, and mechanical installation members are configured to detachably couple the LED bulb to the lamp cup shell.

9 Claims, 10 Drawing Sheets

(51) Int. Cl.

| | |
|---|---|
| ***F21V 29/77*** | (2015.01) |
| ***F21V 3/00*** | (2015.01) |
| ***F21V 23/00*** | (2015.01) |
| ***F21V 1/02*** | (2006.01) |
| ***F21V 21/108*** | (2006.01) |
| ***F21V 19/02*** | (2006.01) |

(52) U.S. Cl.
CPC ..... *F21V 21/108* (2013.01); *F21V 23/005* (2013.01); *F21V 23/06* (2013.01)

(56) References Cited

U.S. PATENT DOCUMENTS

2011/0109217 A1* 5/2011 Kang ..... F21V 29/004 313/46
2012/0218748 A1* 8/2012 Conrad ..... F21V 19/0055 362/230
2013/0294085 A1* 11/2013 Watanabe ..... B29C 45/14467 362/294
2014/0268803 A1* 9/2014 Keng ..... F21V 5/04 362/294
2014/0347846 A1* 11/2014 Ahn ..... F21S 8/036 362/147
2015/0167953 A1* 6/2015 Huang ..... F21V 19/0035 362/294
2015/0377461 A1* 12/2015 Hutchins ..... F21S 8/065 362/237
2016/0377234 A1* 12/2016 Kwong ..... F21V 29/773 362/234

OTHER PUBLICATIONS

Application 201620847781.2, published Jan. 25, 2017, CN 205909101 U, pp. 1-19.*

* cited by examiner

LIGHTING FIXTURE

CROSS-REFERENCE TO RELATED APPLICATION(S)

This application claims priority to and the benefit of Chinese Application No. 201620847781.2, filed Aug. 4, 2016 in the Chinese Patent and Trademark Office, the entire contents of which are incorporated herein by reference.

FIELD

The present disclosure relates generally to the field of illumination, and in particular to lighting fixtures and LED bulbs.

BACKGROUND

In related art lighting fixtures, many steps are required for the assembly of an LED bulb, the assembly is difficult, and the one or more LED bulbs are directly connected to the commercial power supply via outgoing wires. If one of the LED bulbs on the lighting fixture is damaged, the entire lighting fixture needs to be replaced. Accordingly, related art lighting fixtures with multiple LED bulbs can lead to a tremendous waste of resources.

SUMMARY

The present disclosure is directed to various embodiments of a lighting fixture.

In one embodiment, the lighting fixture includes a lamp support, a lamp arm on the lamp support, a lamp cup shell at the end of the lamp arm, the lamp cup shell defining an installation seat, and a lamp shade configured to be supported on the lamp cup shell. The lighting fixture also includes an LED bulb configured to extend into the installation seat, the LED bulb including a heat sink, an LED lamp panel on a first end of the heat sink, the LED lamp panel including a base board and a plurality of LEDs on the base board, a light transmitting cover covering the LED lamp panel, a bottom case assembly on a second end of the heat sink, the bottom case assembly including an LED power drive module electrically coupled to the LED lamp panel, and electrical connection members configured to electrically couple the LED bulb to the lamp cup shell. The lighting fixture further includes a screw press ring configured to attach the LED bulb to the lamp shade, and mechanical installation members configured to detachably couple the LED bulb to the lamp cup shell.

The lighting fixture may also include a lamp cup shell that includes a ring-shaped locking groove facing toward a center of the lamp cup shell. The mechanical installation members may be a plurality of first hooks facing away from a center of the LED power drive module, and the plurality of first hooks are configured to engage a bottom of the ring-shaped locking groove to detachably couple the LED bulb to the lamp cup shell.

The lighting fixture may also include a ring-shaped locking groove defined in the lamp cup shell, the ring-shaped locking groove facing toward a center of the lamp cup shell, a flange on the LED bulb extending from the end of the power drive module, and a positioning post projecting longitudinally from a surface of the flange. The mechanical installation members may be provided on an installation ring configured to fit over the LED power drive module. The installation ring may include a ring body, a positioning groove on an inner wall of the ring body, and a plurality of second hooks on a bottom of the ring body, the plurality of second hooks facing away from a center of the ring body. The LED bulb may be detachably coupled to the lamp cup shell when the ring body engages the flange, the positioning post is received in the positioning groove, and the plurality of second hooks engage a bottom of the ring-shaped locking groove.

The lighting fixture may also include a first threaded portion on an outer side of the installation seat, a second threaded portion on an end of the LED power drive module, and an installation ring configured to fit over the LED power drive module and the installation seat. The installation ring may include a ring body, and internal threads on an inner wall of the ring body, the internal threads of the installation ring configured to threadedly engage the first threaded portion and the second threaded portion. The LED bulb may be detachably coupled to the lamp cup shell when the internal threads of the installation ring threadedly engage the first threaded portion of the installation seat and the second threaded portion of the LED power drive module.

The lighting fixture may also include a plurality of fixing grooves defined in a side wall of the installation seat, a flange extending from the end of the LED power drive module, and an installation ring configured to fit over the LED power drive module. The installation ring may include a ring body, and a plurality of third hooks on a bottom of the ring body, the plurality of third hooks facing toward a center of the ring body. The LED bulb may be detachably coupled to the lamp cup shell when the ring body engages the flange, and the plurality of third hooks engage the plurality of fixing grooves.

The fixing grooves may also have at least one L-shaped fixing groove, the L-shaped fixing groove including a lateral portion and a longitudinal portion connected to the lateral portion. The top surface of the lateral portion may include a downwardly inclined transition section, a horizontal end, and a protruding detent extending out from between the transition section and the horizontal end. At least one of the third hooks may be configured to engage the horizontal end.

The lighting fixture may also include a plurality of fixing bosses extending from a side wall of the installation seat, a longitudinal fixing threaded hole defined in at least one of the fixing bosses, a flange extending from a bottom of the LED power drive module, a positioning post projecting longitudinally from a surface of the flange, and a screw configured to threadedly engage the longitudinal fixing threaded hole. The mechanical installation members may be provided on an installation ring configured to fit over the LED power drive module. The installation ring may include a ring body, a positioning groove, a plurality of slots in an inner wall of the ring body, and a turn-down rim on a bottom surface of the ring body. The LED bulb may be detachably coupled to the lamp shell when the ring body engages the flange of the LED power drive module, the positioning post is received in the positioning groove, the turn-down rim engages the fixing bosses, the screw is received in one of the plurality of slots, and the screw threadedly engages the longitudinal fixing threaded hole to lock the LED bulb to the installation seat.

The lighting fixture may also include a power outlet extending from an end of the installation seat. Also the electrical connection members may include a plurality of power plugs extending from the end of the LED power drive module. The power outlet may be configured to engage the power plugs to electrically couple the LED bulb to the lamp cup shell.

The engagement between at least one of the plurality of power plugs and the power outlet may be a snap connection or a threaded connection.

The heat sink of the LED bulb may include a base and a plurality of heat sink fins arranged around the base, the heat sink defining external threads configured to threadedly engage the screw press ring. Also the lamp shade may include a through hole configured to accommodate the heat sink. Further the LED bulb may be detachably coupled to the lamp shade when the screw press rings engages the external threads of the heat sink fins.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
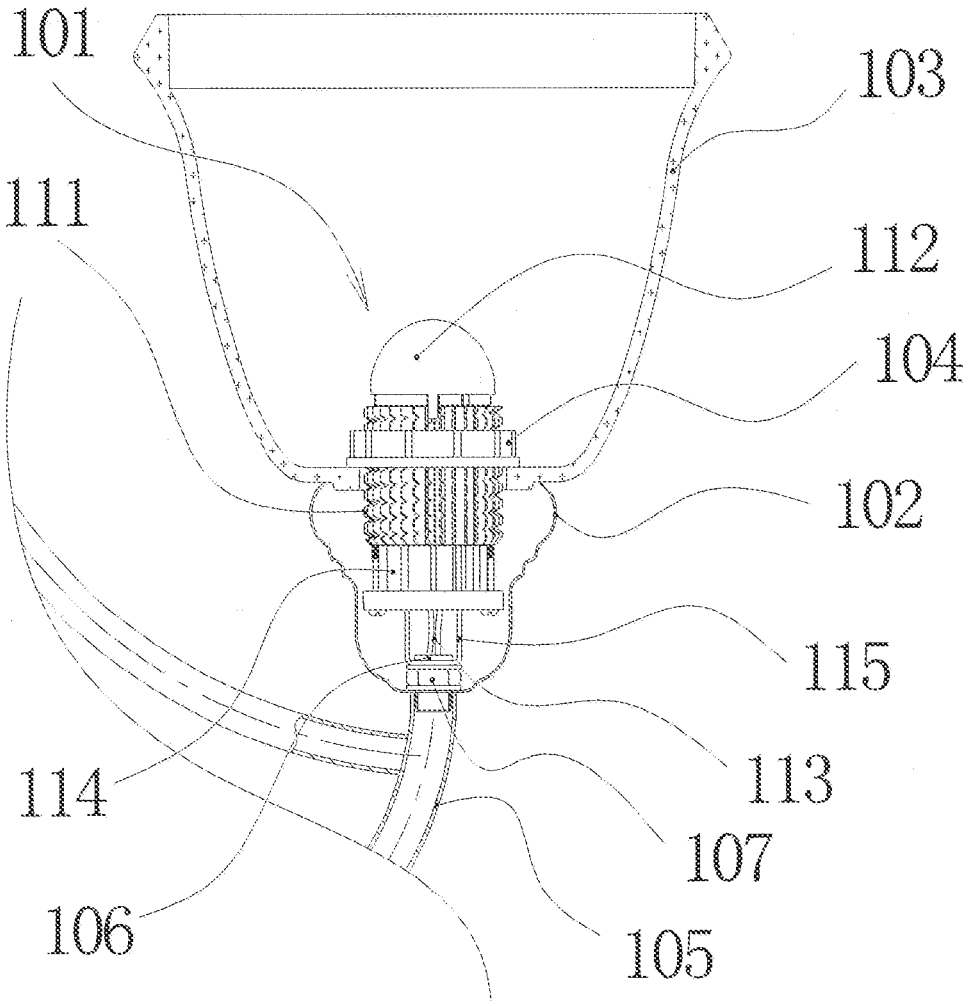
FIG. 1 is a schematic diagram of a comparative example lighting fixture according to the related art.

The present disclosure is directed to various embodiments of a lighting fixture including an LED bulb (e.g., an alternating current LED bulb i.e. ACLED) and a lamp cup shell. Mechanical installation members and electrical connection members are provided to detachably couple the LED bulb to the lamp cup shell, so that the LED bulb is connected directly to the lamp cup shell. This results in an easy assembly and a simpler structure than related art lighting fixtures. Also, the LED bulb is a replaceable part which may be separately replaced without replacing the entire lighting fixture, which avoids a waste of resources. Further, a variety of connection modes for the LED bulb and the lamp cup shell can accommodate different needs. Additionally, the lighting fixture according to various embodiments of the present disclosure includes a screw press ring configured to engage external threads on the LED bulb to detachably couple the LED bulb to a lamp shade. This configuration results in the light-emitting portion of the LED bulb being close to the lamp shade, so that no shadow exists at the bottom of the lamp shade and the visual effect is improved over related art lighting fixtures.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

With reference now to FIG. 1, a comparative example lighting fixture, which is provided for comparative purposes only and is not to be taken as conceded prior art, includes a lamp support (not shown), a hollow lamp arm 105 disposed on the lamp support, a lamp cup shell 102 installed at the end of the lamp arm 105, a lamp shade 103, a screw press ring 104, and LED bulbs 101. The end of the lamp arm 105 is further provided with a bolt 106 and a nut 107. The LED bulb 101 comprises a heat sink 111, a light transmitting cover 112 and an LED lamp panel installed on the top of the heat sink. An LED power drive module 114 is installed on the bottom of the heat sink 111. The LED lamp panel includes a base board and a number of LEDs installed on the base board. Two outgoing wires 113 extend into the lamp arm 105 from the bottom of the LED power drive module 114 for connection to a commercial power supply. The bottom of the LED power drive module 114 is further provided with a bracket 115, and a central threaded hole is formed in the center of the bracket 115. The lamp cup shell 102 is locked to the end of the lamp arm 105 through the engagement between the nut 107 and the bolt 106. The LED bulb 101 is fixed inside the lamp cup shell 102 of the lamp arm 105 through the engagement between the central threaded hole of the bracket 115 and the threads of the bolt 106. The external surface of the heat sink 111 is formed with external threads for engagement with the internal threads of the screw press ring 104. The lamp shade 103 fits over the heat sink 111 through a through hole on its bottom, and the screw press ring 104 is screwed to the outer side of the heat sink 111 through the engagement with external threads of the heat sink 111 such that the lamp shade 103 is locked to the lamp cup shell 102.

Figure 2:
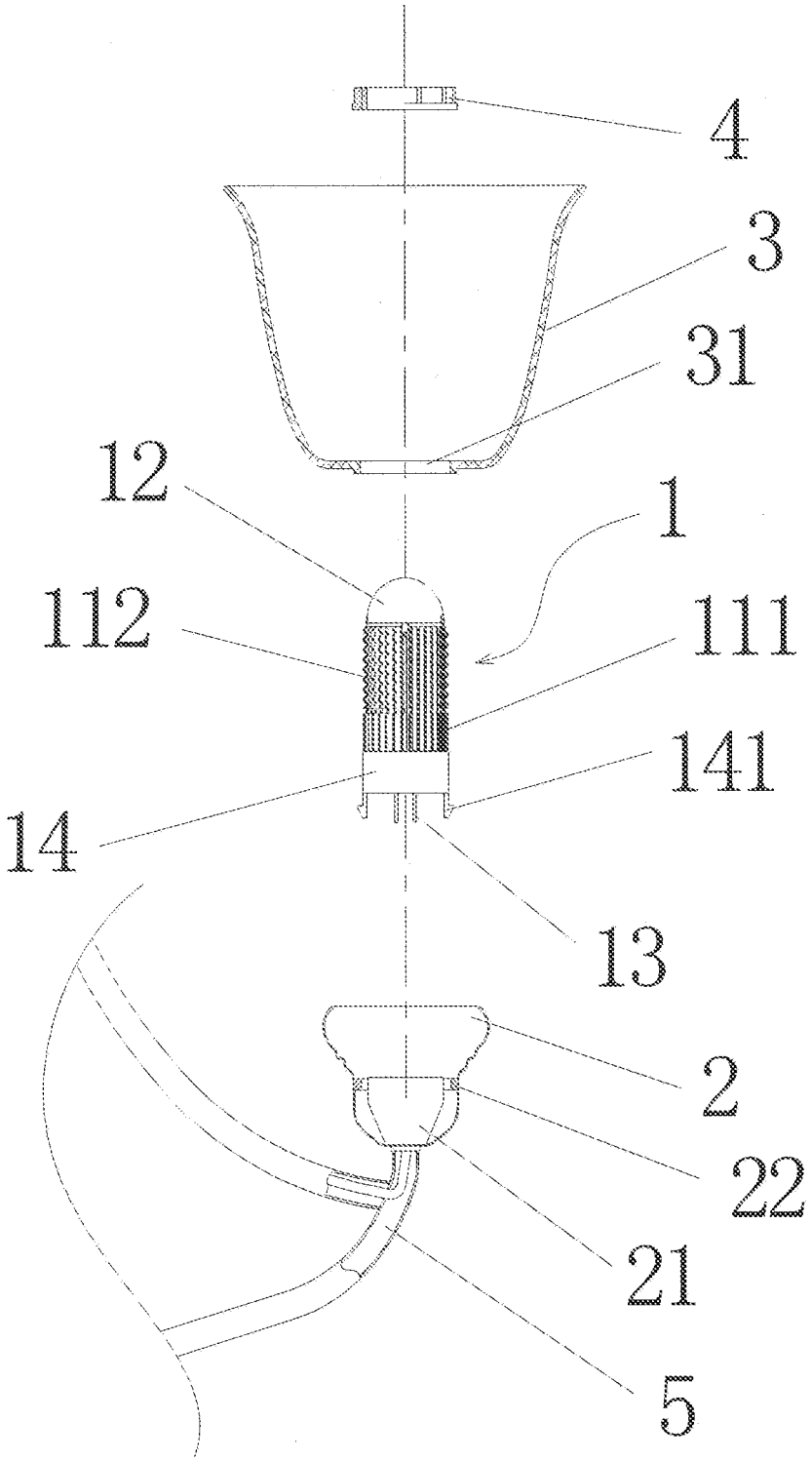
FIG. 2 is an exploded view of parts of a lighting fixture according to one embodiment of the present disclosure.
Figure 3:
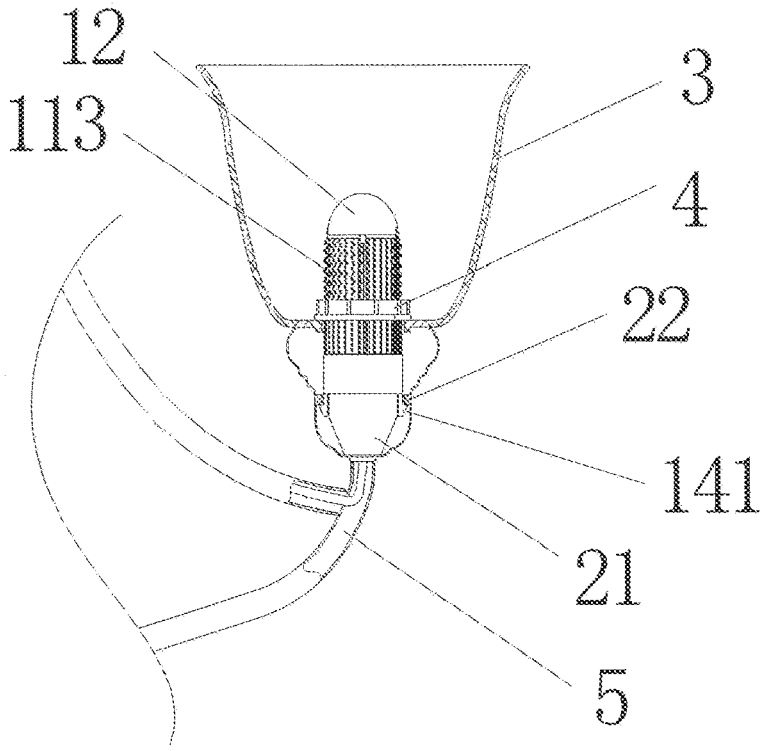
FIG. 3 is an assembled view of the lighting fixture according to one embodiment of the present disclosure.
Figure 4:
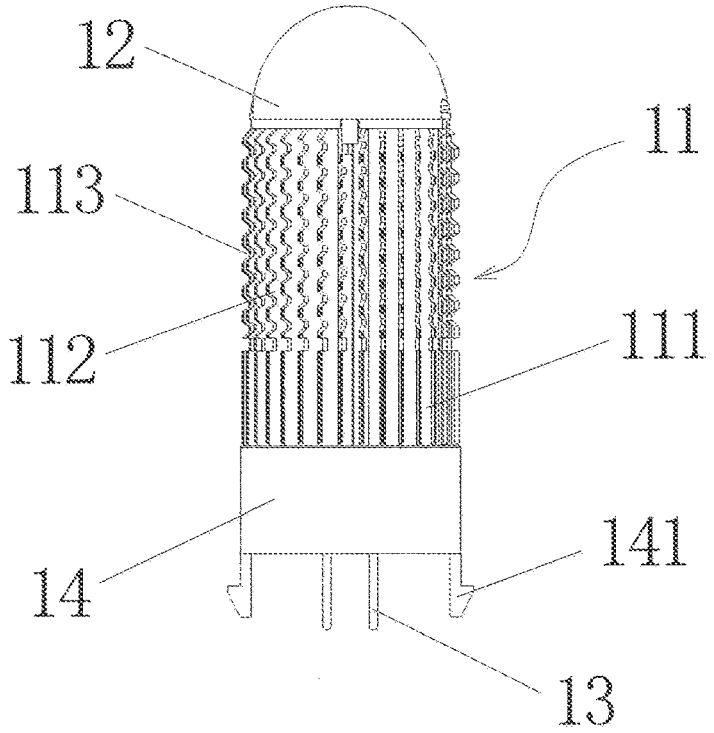
FIG. 4 is a schematic diagram of the structure of an LED bulb according to one embodiment of the present disclosure.

With reference now to FIGS. 2, 3, and 4, a lighting fixture according to one embodiment of the present disclosure includes a lamp support (not shown), a lamp arm 5 on the lamp support, a lamp cup shell 2 at an end of the lamp arm 5, the lamp cup shell 2 defining an installation seat 21, a lamp shade 3 configured to be supported on the lamp cup shell 2, an LED bulb 1, and a screw press ring 4. The lamp cup shell 2 is connected to the lamp arm, and the LED bulb 1 is configured to extend into the installation seat 21 of the lamp cup shell 2. The LED bulb 1 includes a heat sink 11, a light transmitting cover 12 and an LED lamp panel on a first end of the heat sink 11, and an LED power drive module 14 on a second end of the heat sink 11. The LED lamp panel includes a base board and a plurality of LEDs installed on the base board. The LED bulb 1 also includes electrical connection members configured to electrically couple the LED bulb 1 to the lamp cup shell 2. The lighting fixture also includes mechanical installation members configured to detachably couple the LED bulb 1 to the lamp cup shell 2. Accordingly, unlike the comparative example lighting fixture depicted in FIG. 1, the embodiment of the lighting fixture depicted in FIGS. 2-4 includes an LED bulb 1 that is readily detachable from the lamp cup shell 2.

In the illustrated embodiment, the lamp cup shell 2 includes a ring-shaped locking groove 22 facing toward a center of the lamp cup shell 2. The mechanical installation members include a plurality of first hooks (e.g., catches) 141 extending from an end (e.g., the bottom) of the LED power drive module 14 and facing away from a center of the LED power drive module 14. The first hooks 141 are configured to engage a bottom of the ring-shaped locking groove 22 to detachably couple the LED bulb 1 to the lamp cup shell 2.

In one or more embodiments, a power outlet extends from an end (e.g., the upper end) of the installation seat 21. The electrical connection members include a plurality of power plugs 13 extending from an end (e.g., the bottom) of the LED power drive module 14, and the power outlet is configured to engage the power plugs 13 to electrically couple the LED bulb 1 to the lamp cup shell 2.

In one or more embodiments, the engagement between at least one of the plurality of power plugs 13 and the power outlet is a snap connection or threaded connection.

In the illustrated embodiment, the heat sink 11 of the LED bulb 1 includes a base 111 and a plurality of heat sink fins 112 arranged (e.g., circumferentially arranged) around the base 111. The heat sink fins 112 define external threads 113 configured to threadedly engage the screw press ring 4. The lamp shade 3 includes a through hole 31 to accommodate the heat sink 11. The engagement between the screw press ring 4 and the external threads 113 of the heat sink fins detachably couples the LED bulb 1 to the lamp shade 3.

Figure 5:
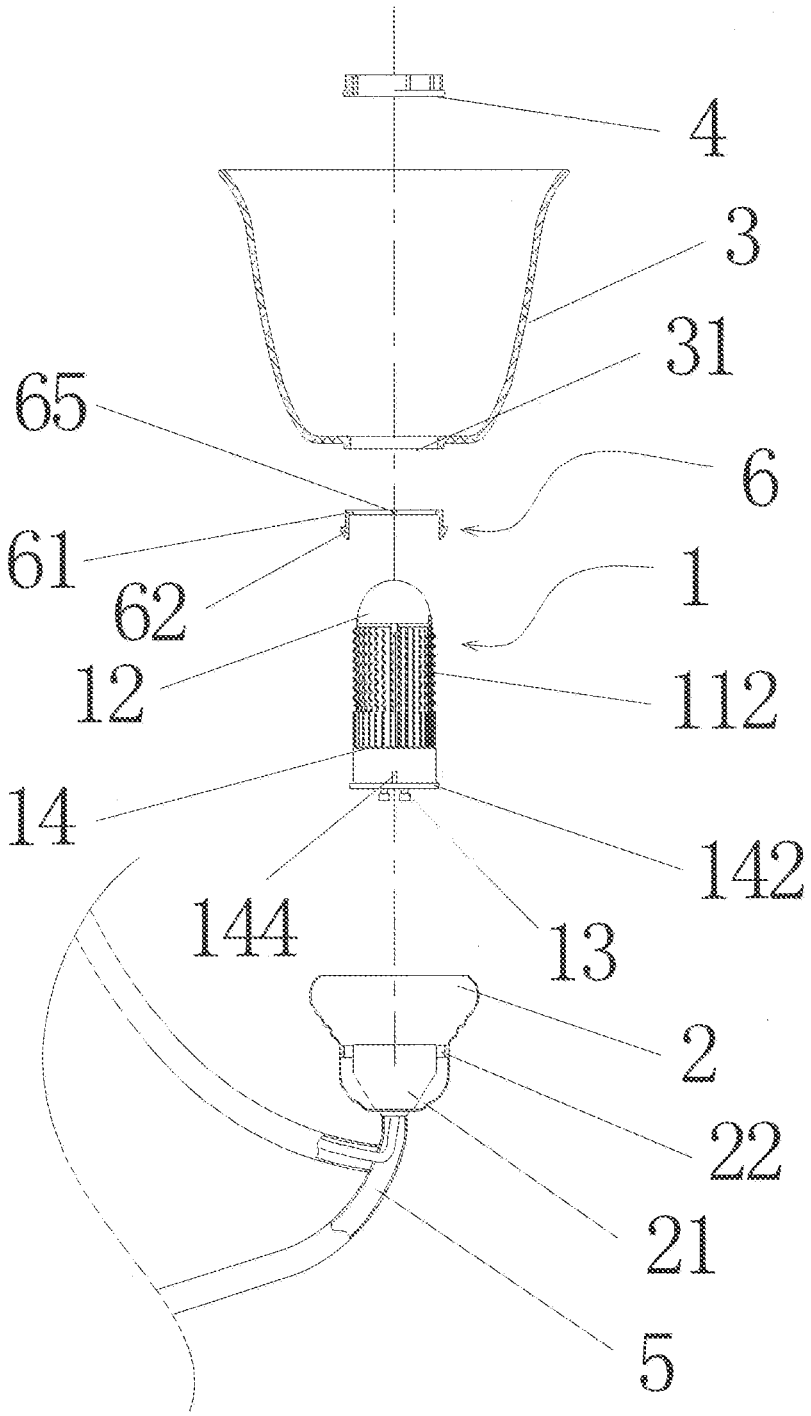
FIG. 5 is an exploded view of parts of a lighting fixture according to another embodiment of the present disclosure.

FIG. 5 depicts a lighting fixture according to another embodiment of the present disclosure. In FIG. 5, some of the same reference numbers used in the embodiment of the lighting fixture depicted in FIGS. 2-4 are used to refer to the same or similar components. However, components having the same reference numbers in the embodiment depicted in FIGS. 2-4 and the embodiment depicted in FIG. 5 may not be identical and, instead, may include differences as described below. In the embodiment of the lighting fixture illustrated in FIG. 5, lamp cup shell 2 includes a ring-shaped locking groove 22 facing toward a center of the lamp cup shell 2, a flange 142 on the LED bulb 1 extending from the end of the power drive module 14, and a positioning post (e.g., a rod) 144 projecting longitudinally from a surface of the flange 142. The mechanical installation members for detachably coupling the LED bulb 1 to the lamp cup shell 2 are provided on a separate installation ring 6 configured to fit over the LED power drive module 14. In the illustrated embodiment, the installation ring 6 defines an opening (e.g., a hole) configured (e.g., sized and shaped) to fit over the heat sink 11 and the LED power drive module 14. The opening in the installation ring 6 is smaller than the flange 142 on the bottom of the LED bulb 1 (e.g., the opening in the installation ring 6 has a smaller diameter than the flange 142 on the bottom of the LED bulb 1) such that the installation ring 6 is configured to engage or be supported on the flange 142 of the LED bulb 1. The installation ring 6 includes a ring body 61, a positioning groove 65 on an inner wall of the ring body 61, and a series of second hooks (e.g., catches) 62 on a bottom of the ring body 61. In the illustrated embodiment, the second hooks 62 face away from a center of the ring body 61. When the LED bulb 1 is detachably coupled to the lamp cup shell 2, the ring body 61 engages the flange 142, the positioning post 144 is received in the positioning groove 65, and the plurality of second hooks 62 engage a bottom of the ring-shaped locking groove 22.

Figure 6:
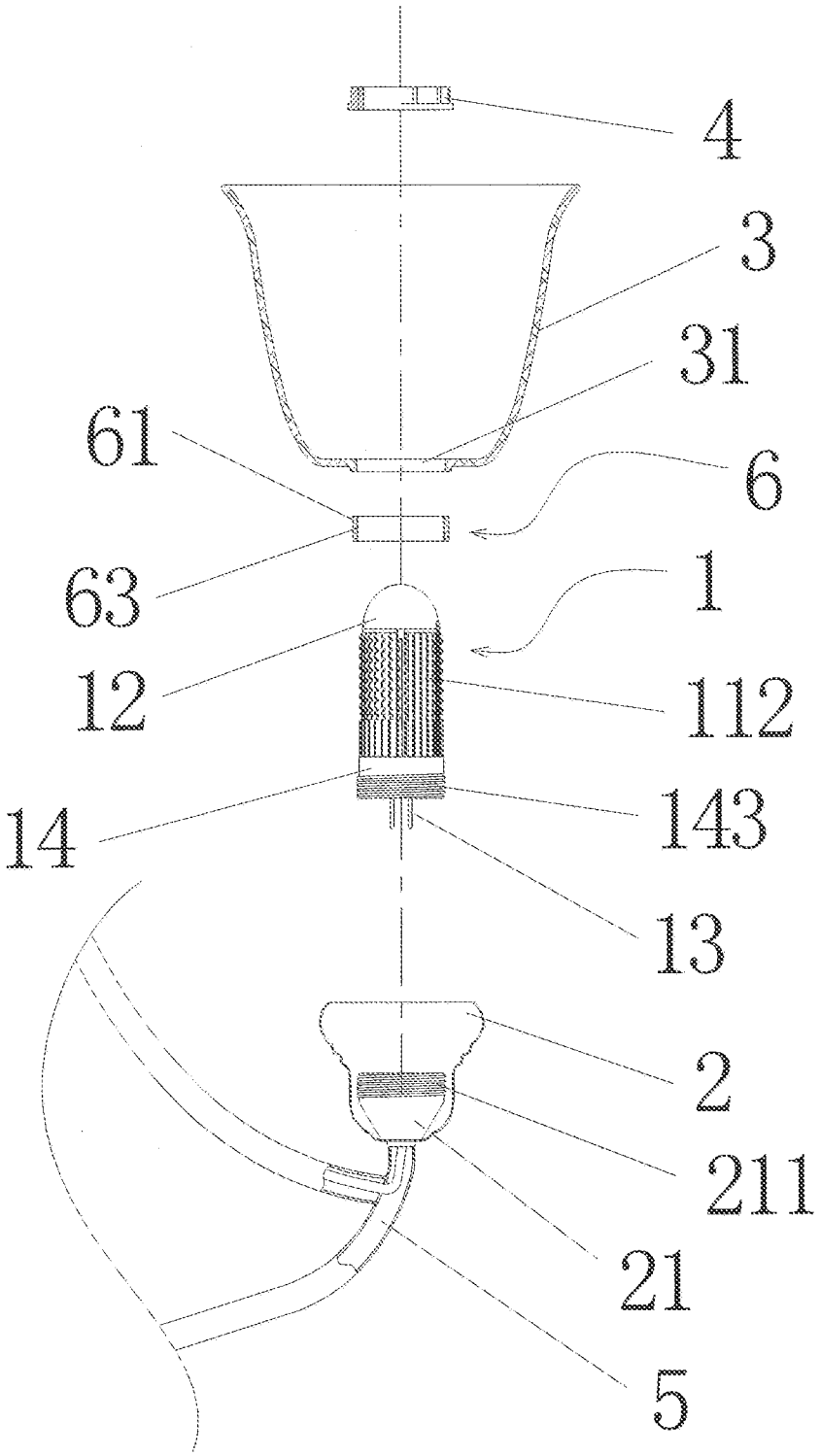
FIG. 6 is an exploded view of parts of a lighting fixture according to a further embodiment of the present disclosure.

FIG. 6 depicts a lighting fixture according to another embodiment of the present disclosure. In FIG. 6, some of the same reference numbers used in the embodiments of the lighting fixture depicted in FIGS. 2-4 and FIG. 5 are used to refer to the same or similar components. However, components having the same reference numbers in the embodiments depicted in FIGS. 2-4 and FIG. 5 and the embodiment depicted in FIG. 6 may not be identical and, instead, may include differences as described below. In the embodiment of the lighting fixture illustrated in FIG. 6, an outer side of the installation seat 21 includes a first threaded portion 211 and an end (e.g., the bottom) of the LED power drive module 14 of the LED bulb 1 includes a second thread portion 143. An installation ring 6 is configured to fit over the LED power drive module 14 and the installation seat 21. In the illustrated embodiment, the installation ring 6 defines an axial opening (e.g., a hole) configured (e.g., sized and shaped) to fit over the heat sink 11 and the LED power drive module 14 of the LED bulb 1 and over the installation seat 21 of the lamp cup shell 2. The installation ring 6 includes a ring body 61, and internal threads 63 on an inner wall of the ring body 61. The internal threads 63 of the installation ring 6 are configured to threadedly engage the first threaded portion 211 of the installation seat 21 of the lamp cup shell 2 and the second threaded portion 143 of the LED bulb 1. When the LED bulb 1 is detachably coupled to the lamp cup shell 2, the internal threads 63 of the installation ring 6 threadedly engage the first threaded portion 211 of the installation seat 21 and the second threaded portion 143 of the LED power drive module 14.

Figure 7:
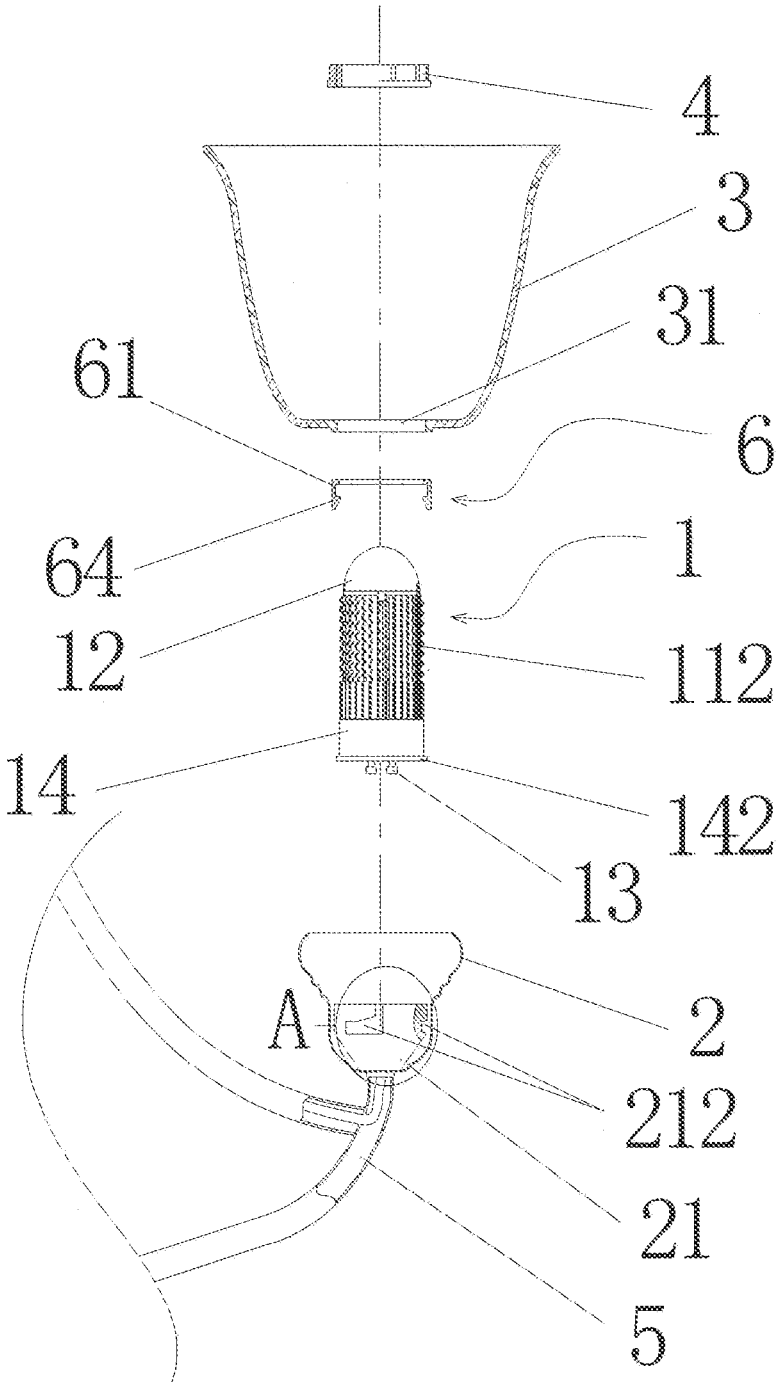
FIG. 7 is an exploded view of parts of a lighting fixture according to an embodiment of the present disclosure.

FIG. 7 depicts a lighting fixture according to another embodiment of the present disclosure. In FIG. 7, some of the same reference numbers used in the embodiments of the lighting fixture depicted in FIGS. 2-4, FIG. 5, and FIG. 6 are used to refer to the same or similar components. However, components having the same reference numbers in the embodiments depicted in FIGS. 2-4, FIG. 5, and FIG. 6 and the embodiment depicted in FIG. 7 may not be identical and, instead, may include differences as described below. In the embodiment illustrated in FIG. 7, the lighting fixture includes a plurality of fixing grooves (e.g., channels) 212 defined in an outer side wall of the installation seat 21, a flange 142 on the LED bulb 1 extending from the end of the power drive module 14, and an installation ring 6 configured to fit over the LED power drive module 14. In the illustrated embodiment, the installation ring 6 defines an opening (e.g., a hole) configured (e.g., sized and shaped) to fit over the heat sink 11 and the LED power drive module 14. The opening in the installation ring 6 is smaller than the flange 142 on the bottom of the LED bulb 1 (e.g., the opening in the installation ring 6 has a smaller diameter than the flange 142 on the bottom of the LED bulb 1) such that the installation ring 6 is configured to engage or be supported on the flange 142 of the LED bulb 1. The installation ring 6 includes a ring body 61 and a plurality of third hooks (e.g., catches 64) on a bottom of the ring body 61. The plurality of third hooks 64 face toward a center of the ring body 61. When the LED bulb 1 is detachably coupled to the lamp cup shell 2, the ring body 61 engages the flange 142, and the plurality of third hooks 64 engage the plurality of fixing grooves 212 in the installation seat 21 of the lamp cup shell 2.

Figure 8:
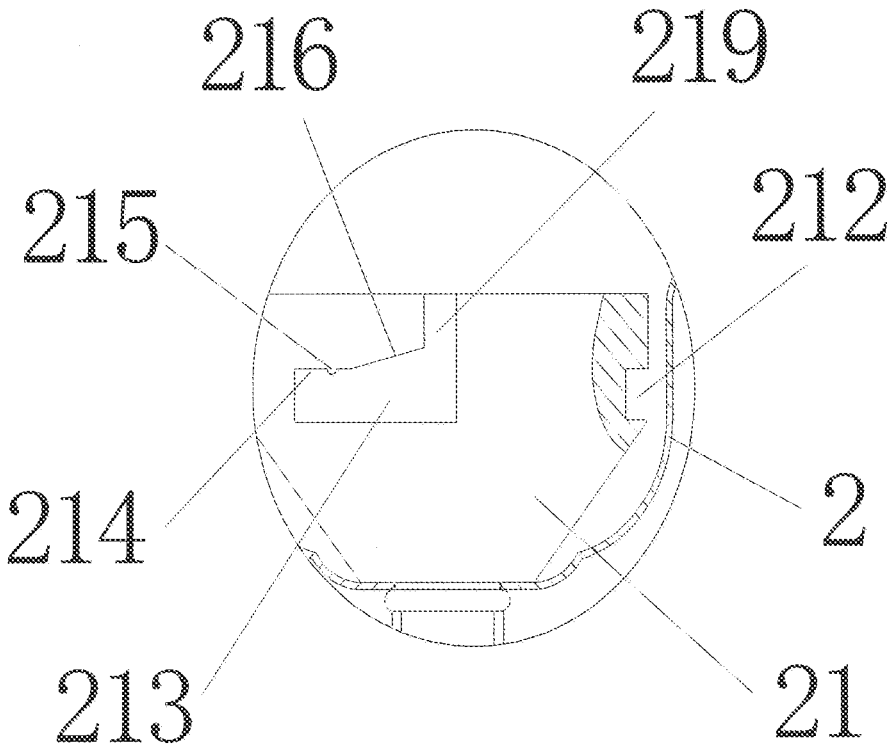
FIG. 8 is an enlarged, detail view of area A in FIG. 7.
Figure 9:
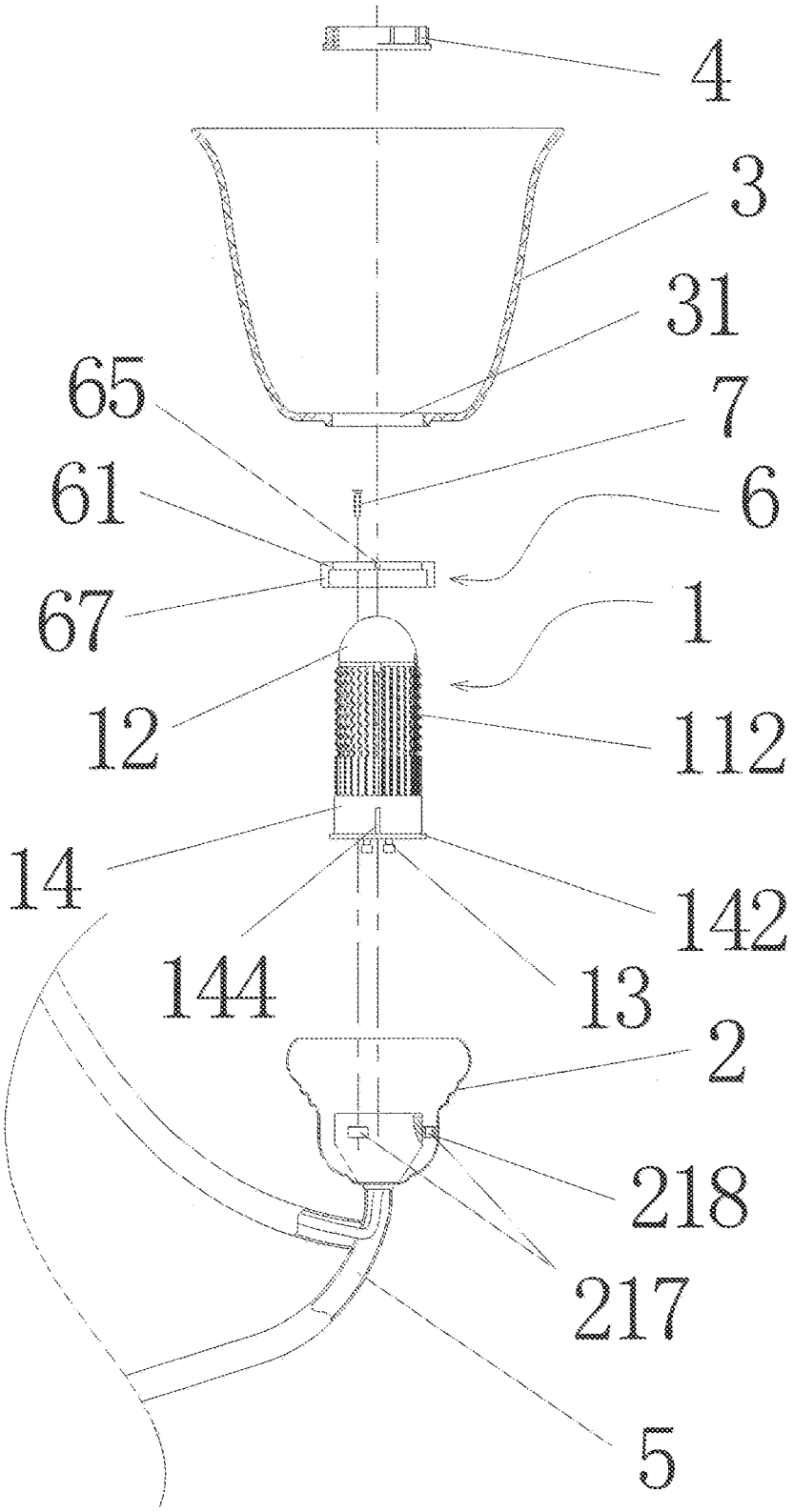
FIG. 9 is an exploded view of parts of a lighting fixture according an embodiment of the present disclosure.
Figure 10:
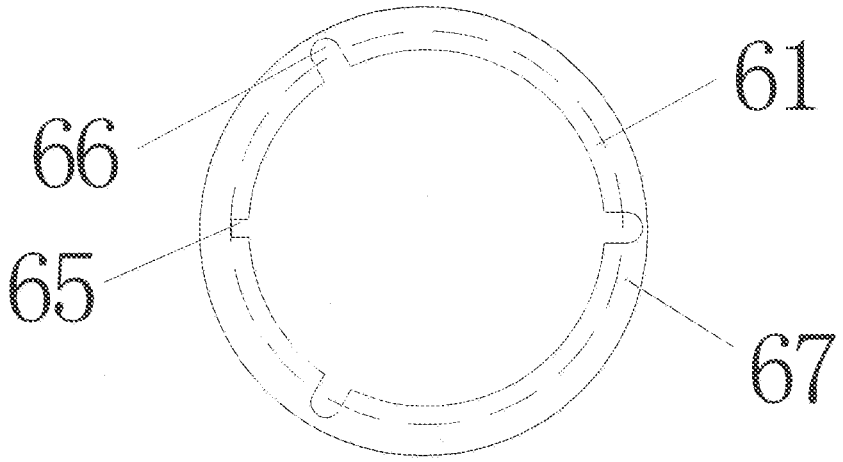
FIG. 10 is a top view of an installation ring according to an embodiment of the present disclosure.
Figure 11:
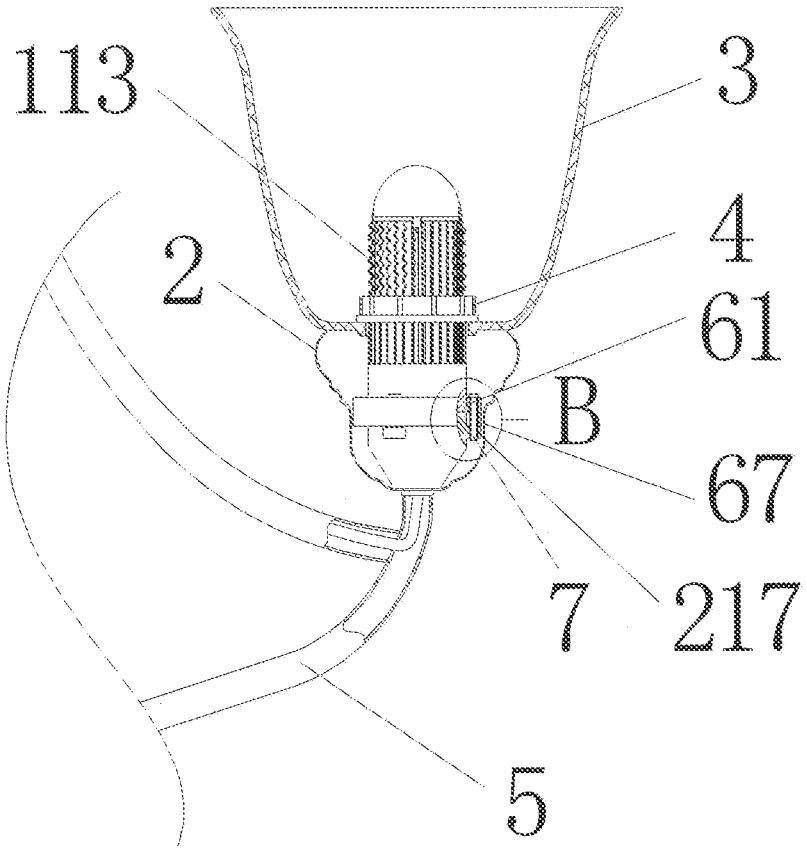
FIG. 11 is an assembled view of the lighting fixture according to an embodiment of the present disclosure.
Figure 12:
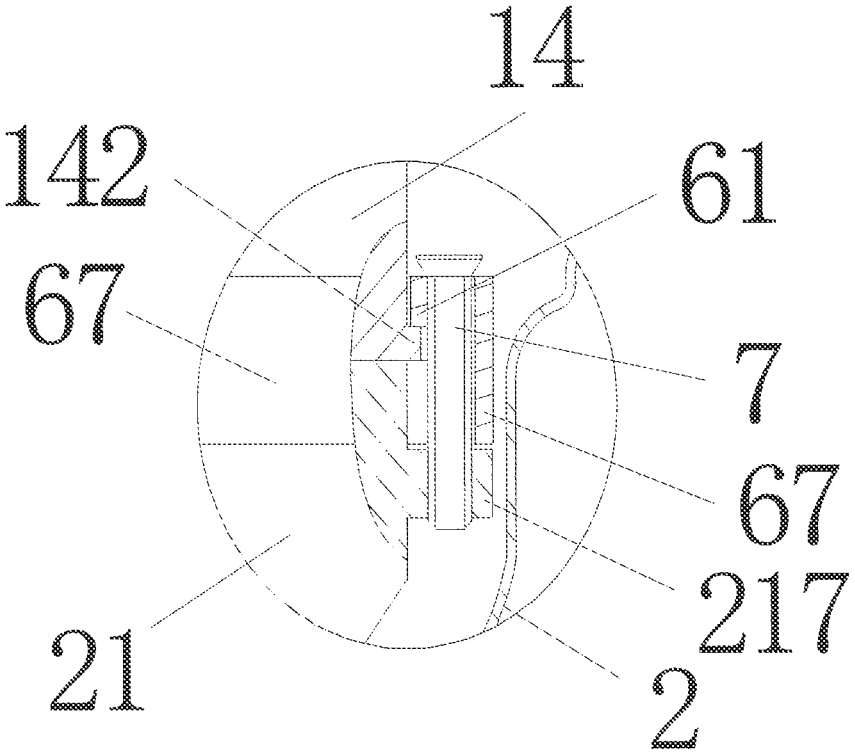
FIG. 12 is an enlarged, detail view of area B in FIG. 11.

In the embodiment illustrated in FIG. 8, at least one of the plurality of fixing grooves 212 is an L-shaped fixing groove. The L-shaped fixing groove includes a lateral portion 213 and a longitudinal portion 219 connected to the lateral portion 213. A top or upper surface of the lateral portion 213 includes a downwardly sloping transition section 216, a horizontally end 214, and a protruding detent (e.g., a stop) 215 extending out from a portion of the lateral portion 213 between the transition section 216 and the horizontal end 214. At least one of the plurality of third hooks 64 is configured to engage the horizontal end 214.

FIGS. 9-12 depict a lighting fixture according to another embodiment of the present disclosure. In FIGS. 9-12, some of the same reference numbers used in the embodiments of the lighting fixture depicted in FIGS. 2-4, FIG. 5, FIG. 6, and FIGS. 7-8 are used to refer to the same or similar components. However, components having the same reference numbers in the embodiments depicted in FIGS. 2-4, FIG. 5, FIG. 6, and FIGS. 7-8 and the embodiment depicted in FIGS. 9-12 may not be identical and, instead, may include differences as described below. With reference now to the embodiment illustrated in FIGS. 9-12, the lighting fixture includes a series of fixing bosses (e.g., protrusions) 217 extending outward from a side wall of the installation seat 21, a flange 142 on the LED bulb 1 extending from the end of the LED power drive module 14, and a positioning post (e.g., a rod) 144 projecting longitudinally from a surface of the flange 142. In the illustrated embodiment, a longitudinal fixing threaded hole 218 is defined in at least one of the fixing bosses 217. A screw 7 is configured to threadedly engage the longitudinal fixing threaded hole 218. The mechanical installation members for detachably coupling the LED bulb 1 to the lamp cup shell 2 are provided on an installation ring 6 configured to fit over the LED power drive module 14. In the illustrated embodiment, the installation ring 6 defines an opening (e.g., a hole) configured (e.g., sized and shaped) to fit over the heat sink 11 and the LED power drive module 14. The opening in the installation ring 6 is smaller than the flange 142 on the bottom of the LED bulb 1 (e.g., the opening in the installation ring 6 has a smaller diameter than the flange 142 on the bottom of the LED bulb 1) such that the installation ring 6 is configured to engage or be supported on the flange 142 of the LED bulb 1. The installation ring 6 includes a ring body 61, a positioning groove 65, a plurality of slots 66 in an inner wall of the ring body 61 (see FIG. 10), and a turn-down rim 67 on a bottom surface of the ring body 61. When the LED bulb 1 is detachably coupled to the lamp cup shell 2, the ring body 61 engages the flange 142 of the LED power drive module 14, the positioning post 144 of the LED bulb 1 is received in the positioning groove 65 of the installation ring 6, the turn-down rim 67 engages the fixing bosses 217, the screw 7 is received in one of the plurality of slots 66, and the screw 7 threadedly engages the longitudinal fixing threaded hole 218 in one of the fixing bosses 217 to lock the LED bulb 1 to the installation seat 21 of the lamp cup shell 2.

What is claimed is:

1. A lighting fixture, comprising:

a lamp arm;

a lamp cup shell at an end of the lamp arm, the lamp cup shell defining an installation seat;

a lamp shade configured to be supported on the lamp cup shell;

an LED bulb configured to extend into the installation seat, the LED bulb comprising:

a heat sink;

a light transmitting cover at a first end of the heat sink; and an LED power drive module at a second end of the heat sink; and electrical connection members configured to electrically couple the LED bulb to the lamp cup shell;

a screw press ring configured to attach the LED bulb to the lamp shade; and mechanical installation members configured to detachably couple the LED bulb to the lamp cup shell, wherein the lamp cup shell further comprises a ring-shaped locking groove facing toward a center of the lamp cup shell, and wherein the mechanical installation members comprise a plurality of first hooks facing away from a center of the LED power drive module, the plurality of first hooks configured to engage a bottom of the ring-shaped locking groove to detachably couple the LED bulb to the lamp cup shell.

2. A lighting fixture, comprising:

a lamp arm;

a lamp cup shell at an end of the lamp arm, the lamp cup shell defining an installation seat;

a lamp shade configured to be supported on the lamp cup shell;

an LED bulb configured to extend into the installation seat, the LED bulb comprising:

a heat sink;

a light transmitting cover at a first end of the heat sink; and an LED power drive module at a second end of the heat sink; and electrical connection members configured to electrically couple the LED bulb to the lamp cup shell;

a screw press ring configured to attach the LED bulb to the lamp shade;

mechanical installation members configured to detachably couple the LED bulb to the lamp cup shell;

a ring-shaped locking groove defined in the lamp cup shell, the ring-shaped locking groove facing toward a center of the lamp cup shell;

a flange on the LED bulb extending from the end of the LED power drive module; and a positioning post projecting longitudinally from a surface of the flange, wherein the mechanical installation members are provided on an installation ring configured to fit over the LED power drive module, the installation ring comprising a ring body, a positioning groove on an inner wall of the ring body, and a plurality of second hooks on a bottom of the ring body, the plurality of second hooks facing away from a center of the ring body, and wherein, when the LED bulb is detachably coupled to the lamp cup shell, the ring body engages the flange, the positioning post is received in the positioning groove, and the plurality of second hooks engage a bottom of the ring-shaped locking groove.

3. A lighting fixture, comprising:

a lamp arm;

a lamp cup shell at an end of the lamp arm, the lamp cup shell defining an installation seat;

a lamp shade configured to be supported on the lamp cup shell;

an LED bulb configured to extend into the installation seat, the LED bulb comprising:

a heat sink;

a light transmitting cover at a first end of the heat sink; and an LED power drive module at a second end of the heat sink; and electrical connection members configured to electrically couple the LED bulb to the lamp cup shell;

a screw press ring configured to attach the LED bulb to the lamp shade;

mechanical installation members configured to detachably couple the LED bulb to the lamp cup shell;

a first threaded portion on an outer side of the installation seat;

a second threaded portion on an end of the LED power drive module; and an installation ring configured to fit over the LED power drive module and the installation seat, the installation ring comprising a ring body, and internal threads on an inner wall of the ring body, the internal threads of the installation ring configured to threadedly engage the first threaded portion and the second threaded portion, wherein, when the LED bulb is detachably coupled to the lamp cup shell, the internal threads of the installation ring threadedly engage the first threaded portion of the installation seat and the second threaded portion of the LED power drive module.

4. A lighting fixture, comprising:

a lamp arm;

a lamp cup shell at an end of the lamp arm, the lamp cup shell defining an installation seat;

a lamp shade configured to be supported on the lamp cup shell;

an LED bulb configured to extend into the installation seat, the LED bulb comprising:

a heat sink;

a light transmitting cover at a first end of the heat sink; and an LED power drive module at a second end of the heat sink; and electrical connection members configured to electrically couple the LED bulb to the lamp cup shell;

a screw press ring configured to attach the LED bulb to the lamp shade;

mechanical installation members configured to detachably couple the LED bulb to the lamp cup shell;

a plurality of fixing grooves defined in a side wall of the installation seat;

a flange on the LED bulb extending from the end of the LED power drive module; and an installation ring configured to fit over the LED power drive module, the installation ring comprising a ring body and a plurality of third hooks on a bottom of the ring body, the plurality of third hooks facing toward a center of the ring body, wherein, when the LED bulb is detachably coupled to the lamp cup shell, the ring body engages the flange, and the plurality of third hooks engage the plurality of fixing grooves.

5. The lighting fixture of claim 4, wherein at least one of the plurality of fixing grooves is an L-shaped fixing groove, the L-shaped fixing groove comprising a lateral portion and a longitudinal portion connected to the lateral portion, wherein the top surface of the lateral portion comprises a downwardly inclined transition section, a horizontal end, and a protruding detent extending out from between the transition section and the horizontal end, and wherein at least one of the plurality of third hooks is configured to engage the horizontal end.

6. A lighting fixture, comprising:

a lamp arm;

a lamp cup shell at an end of the lamp arm, the lamp cup shell defining an installation seat;

a lamp shade configured to be supported on the lamp cup shell;

an LED bulb configured to extend into the installation seat, the LED bulb comprising:

a heat sink;

a light transmitting cover at a first end of the heat sink; and an LED power drive module at a second end of the heat sink; and electrical connection members configured to electrically couple the LED bulb to the lamp cup shell;

a screw press ring configured to attach the LED bulb to the lamp shade;

mechanical installation members configured to detachably couple the LED bulb to the lamp cup shell;

a plurality of fixing bosses extending from a side wall of the installation seat, a longitudinal fixing threaded hole defined in at least one of the fixing bosses;

a flange extending from a bottom of the LED power drive module;

a positioning post projecting longitudinally from a surface of the flange; and a screw configured to threadedly engage the longitudinal fixing threaded hole, wherein the mechanical installation members are provided on an installation ring configured to fit over the LED power drive module, the installation ring comprising a ring body, a positioning groove, a plurality of slots in an inner wall of the ring body, a turn-down rim on a bottom surface of the ring body, and wherein, when the LED bulb is detachably coupled to the lamp cup shell, the ring body engages the flange of the LED power drive module, the positioning post is received in the positioning groove, the turn-down rim engages the fixing bosses, the screw is received in one of the plurality of slots, and the screw threadedly engages the longitudinal fixing threaded hole to lock the LED bulb to the installation seat.

7. The lighting fixture according to claim 1, further comprising a power outlet extending from an end of the installation seat, wherein the electrical connection members comprise a plurality of power plugs extending from the end of the LED power drive module, and wherein the power outlet is configured to engage the power plugs to electrically couple the LED bulb to the lamp cup shell.

8. The lighting fixture of claim 7, wherein an engagement between at least one of the plurality of power plugs and the power outlet is a snap connection or a threaded connection.

9. The lighting fixture of claim 7, wherein the heat sink of the LED bulb comprises a base and a plurality of heat sink fins arranged around the base, the heat sink defining external threads configured to threadedly engage the screw press ring, wherein the lamp shade comprises a through hole configured to accommodate the heat sink, and wherein engagement between the screw press ring and the external threads of the heat sink fins detachably couples the LED bulb to the lamp shade.

* * * * *